United States Patent [19]

Puchta et al.

[11] Patent Number: 4,526,694

[45] Date of Patent: Jul. 2, 1985

[54] ACID-CONTAINING PRODUCT FOR THE TREATMENT OF MOIST WASH IN THE MECHANICAL CLOTHES DRIER

[75] Inventors: Rolf Puchta, Haan; Hans Nüsslein, Langenfeld; Alexander Boeck, Dusseldorf; Benno Streschnak, Krefeld, all of Fed. Rep. of Germany

[73] Assignee: Henkel Kommanditgesellschaft (Henkel KGaA), Dusseldorf, Fed. Rep. of Germany

[21] Appl. No.: 561,200

[22] Filed: Dec. 14, 1983

Related U.S. Application Data

[62] Division of Ser. No. 335,218, Dec. 28, 1981, abandoned.

[30] Foreign Application Priority Data

Jul. 27, 1981 [DE] Fed. Rep. of Germany ..... 3129549

[51] Int. Cl.[3] ..... D06M 13/46

[52] U.S. Cl. ..... 252/8.8; 427/242; 428/289

[58] Field of Search ..... 252/8.8; 428/289; 427/242

[56] References Cited

U.S. PATENT DOCUMENTS 3,936,537 2/1976 Baskerville, Jr. et al. ..... 427/242

4,012,326 3/1977 Rudy et al. ..... 252/8.8

*Primary Examiner*—George F. Lesmes

*Assistant Examiner*—P. R. Schwartz

*Attorney, Agent, or Firm*—Ernest G. Szoke; Nelson Littell, Jr.

[57] ABSTRACT

A composition for coating a flexible textile sheet for the treatment of moist wash in a mechanical clothes drier, consisting essentially of: an active substance selected from the group consisting of textile softening agents, antistatic substances, fragrances, mixtures of the above and mixtures of the above with nonionic emulsifiers and additives, where said textile softening agents and antistatic substances are selected from the group consisting of quaternary nitrogen compounds derived from ammonia or imidazoline and having from 1 to 2 long chain hydrocarbyl groups with from 8 to 26 carbon atoms and mixtures of said quaternary nitrogen compounds with up to 80% by weight of the mixture of the condensation product of a higher fatty acid triglyceride with a hydroxy lower alkylpolyamine, wherein said composition contains from 0.2% to 5% by weight of at least one aliphatic low-molecular-weight hydroxycarboxylic acid, as well as, optionally, from 0.05% to 1% by weight of at least one optical brightener, both based on the total weight of textile softening agents and antistatic substances.

14 Claims, No Drawings

ACID-CONTAINING PRODUCT FOR THE TREATMENT OF MOIST WASH IN THE MECHANICAL CLOTHES DRIER

This is a division of Ser. No. 335,218, filed Dec. 28, 1981, and now abandoned.

BACKGROUND OF THE INVENTION

This invention relates to an improved acid-containing coated product for the treatment of moist wash in a mechanical clothes drier.

The constant spreading in recent times of the use of automatic clothes driers in commercial laundries and in private households offers the possibility of an after-treatment of the wash simultaneously with the drying, in the clothes drier. Consequently, a number of suggestions have been made how various active substances, mainly those for the softening or antistatic treatment as well as for the scenting of the wash, can be applied to it.

In the sixties, a process was described in the USA for the after-treatment of wash in which flexible substrates impregnated with conventional active substances, for example, absorbent rolls of paper, like those used as paper towels, treated with quaternary ammonium compounds, are placed with the still moist wash in the drum of an automatic clothes drier and the drying process is allowed to take place. During drying, the active substances are transferred to the wash in this process. According to the DE-OS No. 19 65 470, corresponding to U.S. Pat. No. 3,686,025, not every flexible carrier material loaded with textile softeners produces good results.

The suitable flexible substrates must possess a certain adsorption capacity lying within a numerically limited range of from 5.5 to 12. Using a substrate with too low an adsorption capacity causes the active substances to be released too quickly according to the information of this patent, so that the active substances are transferred unevenly to the wash and the treated wash becomes spotted. On the other hand, an adsorption capacity lying above the required area is said to result in the release of too little active substance from the substrate to the wash. Certain absorbent papers, sponges and woven clothes or fleeces are mentioned in this patent application as suitable substrates.

Special softeners and softener combinations also are known that can be combined with flexible substrates that do not have to meet such restrictive requirements with respect to adsorption capacity as those in DE-OS No. 19 65 470. For example, a mixture of a regular cationic textile softener and a fatty acid ester of a polyhydric alcohol at a certain mixing ratio is described in the DE-OS No. 27 00 512, corresponding to British Pat. No. 1,571,527. An agent containing a polyglycerine ester with a fatty acid, as textile softener, is known from the DE-OS No. 27 00 560, corresponding to U.S. Pat. No. 4,214,038. In both instances substrates having adsorption capacities down to 2 can then be employed.

From this state of the art the expert had to deduce that the use of conventional textile softeners, for example, the readily available cationic quaternary ammonium compounds, which are excellent softening and antistatic agents, on substrates with an adsorption capacity lower than the minimum adsorption capacity demanded according to the DE-OS No. 19 65 470 is not possible, or that an uneven transfer of softener and, therefore, spotting of the treated textiles is the result.

In the copending, commonly assigned U.S. patent application Ser. No. 225,761, filed Jan. 18, 1981, now abandoned in favor of its continuation, Ser. No. 416,078, filed Sept. 8, 1982, now abandoned, a product for the treatment of moist wash in a mechanical clothes drier is disclosed consisting essentially of:

(a) a flexible textile sheet of woven, fleece or foam-like structure of a substance selected from the group consisting of polyester, polyamide, polyolefin, polyacrylonitrile, polyurethane, viscose and their mixtures, said flexible textile sheet having an adsorption capacity of from 1.0 to 4.5 coated with (b) an effective amount for the drier load of wash of an active substance selected from the group consisting of textile softening agents, antistatic substances, fragrances, mixtures of the above and mixtures of the above with nonionic emulsifiers and additives, particularly where said textile softening agents and antistatic substances are selected from the group consisting of quarternary nitrogen compounds derived from ammonia or imidazoline and having from 1 to 2 long chain hydrocarbyl groups with from 8 to 26 carbon atoms and mixtures of said quaternary nitrogen compounds with up to 80% by weight of the mixture of the condensation product of a higher fatty acid triglyceride with a hydroxy lower alkylpolyamine.

With the substances according to the teachings of the above patent application Ser. No. 225,761, final treatment products for laundry were made available that are derived from substrates with very low adsorption capacity and with the use of known quaternary ammonium compounds derived from ammonia or imidazoline, which are used on a large scale as textile softeners because of their excellent effectiveness. These products do not cause spotting on the laundry when used in the clothes dryer. According to the teaching of the DE-OS No. 19 65 470, spots of irregularly transferred textile softener would have had to be noticed on the laundry with the use of substances with substrates with an adsorption capacity below 5.5. It is known from other patents in the literature that other substances than the usual, highly effective quaternary ammonium compounds must be used as textile softeners, when substrates with an adsorption capacity of less than 5.5 (or more than 12) are desired for use. (See, for example, the German published Application Nos. 27 00 512, 27 00 560; British Pat. No. 1,549,432 and U.S. Pat. Nos. 3,989,631 4,022,938 4,025,444 4,049,858 4,055,248 4,073,996 4,076,633 4,085,052 4,096,071 4,103,047 4,110,498 4,121,009 4,142,978.

Unfortunately, however, the products of Ser. No. 225,761 occasionally will undergo yellowing if kept for a relatively long time.

OBJECTS OF THE INVENTION

An object of the present invention is the development of a composition for coating a flexible textile sheet for the treatment of moist wash in a mechanical clothes drier, consisting essentially of: an active substance selected from the group consisting of textile softening agents, antistatic substances, fragrances, mixtures of the above and mixtures of the above with nonionic emulsifiers and additives, where said textile softening agents and antistatic substances are selected from the group consisting of quaternary nitrogen compounds derived from ammonia or imidazoline and having from 1 to 2 long chain hydrocarbyl groups with from 8 to 26 carbon atoms and mixtures of said quaternary nitrogen compounds with up to 80% by weight of the mixture of the condensation product of a higher fatty acid triglyceride with a hydroxy lower alkylpolyamine, wherein said composition contains from 0.2% to 5% by weight of at least one aliphatic low-molecular-weight hydroxycarboxylic acid, as well as, optionally, from 0.05% to 1% by weight of at least one optical brightener, both based on the total weight of textile softening agents and antistatic substances.

A further object of the present invention is the development of a product for the treatment of moist wash in a mechanical clothes drier consisting essentially of: an active softening composition selected from the group consisting of:

(1) cationic quaternary nitrogen compounds having at least one alkyl group having 8 to 26 carbon atoms,
(2) mixtures of said quaternary nitrogen compounds with small amounts of scenting agents,
(3) mixtures of said quaternary nitrogen compounds with up to an equal part by weight of nonionic surface-active compounds,
(4) mixtures of component (3) with small amounts of scenting agents, and
(5) mixtures of any of components (1) to (4) above wherein part of said quaternary nitrogen compound has been replaced by the condensation products of the condensation of 1 mol of a higher fatty acid triglyceride with a mol of a hydroxy-lower alkyl-lower-alkylenediamine or a hydroxy-lower alkylpolylower-alkylene polyamine, in a ratio by weight of from 4:1 to 1:4 of quaternary nitrogen compound to condensation products, wherein said product contains from 0.2% to 5% by weight of at least one acid selected from the group consisting of hydroxy-lower alkane-carboxylic acid having from 1 to 2 hydroxyls and from 1 to 3 carboxyls, hydroxy-lower alkanediphosphonic acids, amino-tris-lower alkanephosphonic acids, polycarboxyl-lower alkane-phosphonic acids and lower alkylenediamine-tetrakis-(lower alkane-phosphonic acids), as well as, optionally, from 0.05% to 1% by weight of at least one optical brightener, both based on the total weight of said active softening composition.

These and other objects of the invention will become more apparent as the description thereof proceeds.

DESCRIPTION OF THE INVENTION

As a further development of the products of Ser. No. 225,761, it was now found that a substance that contains in the coating an additional 0.2% to 5% by weight of at least one aliphatic, low-molecular-weight hydroxycarboxlic acid or possibly an aliphatic lower-molecular-weight weight phosphonic acid and, optionally, from 0.05% to 1% by weight of optical brighteners, each based on the amounts of softeners and antistatic agents, offers especially valuable properties.

More particularly, therefore, the present invention relates to a product for the treatment of moist wash in a mechanical clothes drier, consisting essentially of:

(a) a flexible textile sheet of woven, fleece or foam-like structure of a substance selected from the group consisting of polyester, polyamide, polyolefin, polyacrylonitrile, polyurethane, viscose and their mixtures, said flexible textile sheet having an adsorption capacity of from 1.0 to 4.5 coated with
(b) an effective amount for the drier load of wash of an active substance selected from the group consisting of textile softening agents, antistatic substances, fragrances, mixtures of the above and mixtures of the above with nonionic emulsifiers and additives, where said textile softening agents and antistatic substances are selected from the group consisting of quaternary nitrogen compounds derived from ammonia or imidazoline and having from 1 to 2 long chain hydrocarbyl groups with from 8 to 26 carbon atoms and mixtures of said quaternary nitrogen compounds with up to 80% by weight of the mixture of the condensation product of a higher fatty acid triglyceride with a hydroxy lower alkylpolyamine, wherein said coating (b) contains from 0.2% to 5% by weight of at least one aliphatic low-molecular-weight hydroxycarboxylic acid, as well as, optionally, from 0.05% to 1% by weight of at least one optical brightener, both based on the total weight of textile softening agents and antistatic substances.

In a more particular fashion, the present invention relates to a product for the treatment of moist wash in a mechanical clothes drier consisting essentially of:

(a) a flexible textile sheet of a fleece of fibers selected from the group consisting of polypropylene fibers, polyester fibers, viscose fibers and mixtures thereof, said fibers in said fleece being bonded together, said flexible textile sheet having an adsorption capacity of from 1.0 to 4.5 coated with
(b) an effective amount for softening of a drier load of wash of an active softening composition selected from the group consisting of:
  (1) cationic quaternary nitrogen compounds having at least one alkyl group having 8 to 26 carbon atoms,
  (2) mixtures of said quaternary nitrogen compounds with small amounts of scenting agents,
  (3) mixtures of said quaternary nitrogen compounds with up to an equal part by weight of nonionic surface-active compounds,
  (4) mixtures of component (3) with small amounts of scenting agents, and
  (5) mixtures of any of components (1) to (4) above wherein part of said quaternary nitrogen compound has been replaced by the condensation products of the condensation of 1 mol of a higher fatty acid triglyceride with a mol of a hydroxy-lower alkyl-lower-alkylenediamine or a hydroxy-lower alkylpolylower-alkylene polyamine, in a ratio by weight of from 4:1 to 1:4 of quaternary nitrogen compound to condensation products, wherein said coating (b) contains from 0.2% to 5% by weight of at least one acid selected from the group consisting of hydroxy-lower alkane-carboxylic acid having from 1 to 2 hydroxyls and from 1 to 3 carboxyls, hydroxy-lower alkane-diphosphonic acids, amino-tris-lower alkanephosphonic acids, polycarboxyl-lower alkane-phosphonic acids and lower alkylenediamine-tetrakis-(lower alkane-phosphonic acids), as well as, optionally, from 0.05% to 1% by weight of at least one optical brightener, both based on the total weight of said active softening composition.

The values of the adsorption capacity are determined with a modified test (U.S. Federal Specifications UU-T-595b), with changes as described in the DE-OS No. 19 65 470, renumbered page 14, and U.S. Pat. No. 4,110,498, columns 8 and 9, and explained in more detail in the example part of Ser. No. 225,761, now abandoned in favor of its continuation, Ser. No. 416,078, filed Sept. 8, 1982, now abandoned.

Suitable low-molecular-weight hydroxycarboxylic acids are preferably hydroxy-lower alkane-carboxylic acids containing 1 or 2 hydroxy groups and 1 to 3 carboxyl groups and have a molecular weight of up to approximately 250. These are particularly acids from the group consisting essentially of malic acid, tartaric acid, tartronic acid, lactic acid, glycolic acid, citric acid and their mixtures. Lactic acid, glycolic acid and particularly citric acid and their mixtures are preferred.

Instead of the mentioned hydroxycarboxylic acids, the products may also contain with the same advantage phosphonic acids, for example, hydroxy-lower alkanediphosphonic acids, such as 1-hydroxyethan-1,1-diphosphonic acid; amino-tris-lower alkane-phosphonic acids, such as amino-tris-(methylenephosphonic acid); polycarboxyl-lower alkanephosphonic acids, such as 2-phosphonobutan-1,2,4-tricarboxylic acid; or lower alkylenediamine-tetrakis-(lower alkane-phosphonic acids), such as ethylenediamine-tetrakis-(methylenephosphonic acid).

When optical brighteners are present, particularly the brighteners for cotton are used as said optical brighteners. These are mainly derivatives of diaminostilbene disulfonic acid or their alkali metal salts.

When the products for the treatment of moist wash contain in the coating material from 0.2% to 5% by weight of the above-mentioned hydroxycarboxylic acids or phosphonic acids as well as, optinally, from 0.05% to 1% by weight of optical brighteners, based respectively on the total amount of softener and antistatic agents, the substances according to the invention can be stored for a relatively long time without yellowing. Besides, the fragrance of the perfumed products for the treatment of moist washed, if perfumed, is markedly improved.

Suitable further additives are especially dispersing agents. Antimicrobial agents, soil-release substances, ironing aids and impregnating agents may be present in addition.

The values for the adsorption capacity are determined with a modified test (U.S. Federal Specifications UU-T-595b) with changes as described in the DE-OS No. 19 65 470, new page 14, corresponding to U.S. Pat. No. 3,686,025, and explained more closely in the example part of copending U.S. patent application Ser. No. 225,761, filed Jan. 18, 1981, both incorporated herein by reference.

The flexible textile sheets with a fleece-like structure are produced in a known manner by depositing thermoplastic or non-thermoplastic fibers, previously cut to the desired length from air or water, or mechanically, preferably in a tangled way for the formation of the fleece, and by fusing these together with a binder or the effect of temperature (in the case of thermoplastic fibers). Thus, a distinction is made between fleeces bound with a binder and those bound due to fused fibers. The type of preparation as well as the type, amount and positioning of the fibers and their binding to each other determine the properties of the suitable fleeces. These properties are not critical for their suitability as flexible substrates in the products according to the invention, however, as long as they have an adsorption capacity of 1.0 to 4.5. Suitable fleeces are from 0.01 to 0.2 $m^2$ in size and have an area weight between about 10 and 100 gm per $m^2$. A commercial fleece exceptionally suitable for the products according to the invention is made, for example, from polyester fibers. It has an area weight of from 25 to 50 gm per $m^2$ and an adsorption capacity of 2 to 4.

Another example for a suitable fleece is one prepared of viscose fibers. It has an area weight of about 55 gm per $m^2$ and an adsorption capacity of about 3.5. Suitable fleece materials are prepared from a fiber mixture, for example, of 40% polyester and 60% viscose. These have an area weight of from 25 to 35 gm per $m^2$ and an adsorption capacity of about 3.5. Another suitable fleece consists of polypropylene fibers. It has an area weight of about 50 gm per $m^2$ and an adsorption capacity of about 2.0. Another fleece of polypropylene fibers has an area weight of about 35 gm per $m^2$ and an adsorption capacity of 2.8. Results similar to those with active substances on fleeces are obtained also with a polyacrylonitrile fiber cloth that has an adsorption capacity of 1.7. Other suitable substrates are polyurethane foams with an adsorption capacity of 3.7 to 4.2. Plastic foam sheets of polyethylene and polypropylene with an adsorption capacity within the range given are suitable substrates as well.

Suitable quaternary nitrogen compounds are mainly those with two long-chain, preferably saturated aliphatic radicals each with 14 to 26, preferably in general 16 to 20, carbon atoms and at least one quaternary nitrogen atom in the molecule. The long-chain, aliphatic radicals can be straight-chained or branched and be derived accordingly from fatty acids, or fatty amines, Guerbet amines or from the alkylamines obtainable by reduction of nitroparaffins. These quaternary nitrogen compounds are mainly derivatives of ammonia, i.e., the quaternary ammonium salts obtained by alkylation of the long-chain secondary amines, for example, the compounds distearyl-dimethylammonium chloride or ditallow alkyl-dimethylammonium chloride or the corresponding methosulfates. Other suitable nitrogen compounds are the imidazoline compounds obtainable by reaction of 1 mol of an aminoalkylethylenediamine or hydroxyalkylethylenediamine with 2 mols of a long-chain $C_{12}$–$C_{26}$-fatty acid or their esters, which are subsequantly converted into the quaternary imidazolinium compounds by alkylation. In all of these quaternary nitrogen compounds the anion generally consists of the acid radical that is formed from the alkylation agent used in the reaction to produce the quaternary compound. Thus, chloride, bromide, methylsulfate, ethylsulfate, methanesulfonate, ethanesulfonate or toluenesulfonate are suitable as anions, for example. The quaternary compounds are good antistatic agents at the same time. Part of the quaternary nitrogen compounds can be replaced by other comounds, for example, the condensation products of 1 to 3 mols of higher fatty acid or alkyl esters of higher fatty acids or $\frac{1}{3}$ to 1 mol of higher fatty acid triglyceride with one mole of a hydroxyalkylpolyamine, e.g., hydroxyethylethylenediamine, hydroxyethyldiethylenetriamine, which are also known as textile softeners. Particularly suitable is the product obtainable by the reaction of 1 mol of a fatty acid triglyceride, particularly hardened tallow, with 1 mol hydroxyethylethylenediamine at 90° to 150° C. The textile softener used preferably is a quaternary nitrogen compound of the quaternary ammonium type with two largely $C_{16}$–$C_{20}$-alkyl- or alkenyl groups and two methyl groups in the molecule and with the chloride, bromide or methylsulfate anion, especially ditallow alkyl-dimethylammonium chloride, alone or in combination with the fatty acid condensation product of 1 mol of hardened tallow and 1 mol of hydroxyethylethylenediamine at a ratio of 4:1 to 1:4. These combinations result in a uniform, pronounced improvement of the feel of the treated textiles without spotting.

Most suitable as nonionic dispersing agents or surface-active compounds are adducts of 4 to 40, preferably 4 to 20, mols of ethylene oxide with 1 mol of an aliphatic $C_{10}$–$C_{20}$-alcohol or an alkylphenol, in which the alkyl radical has 8 to 18 carbon atoms, 1 mol of higher fatty acids and alkylamines with 10 to 20 carbon atoms may also be employed. Especially preferred are the ethoxylation products of fatty alcohols, especially the fatty alcohols of tallow and coconut oil and of oleyl alcohol, as well as the ethoxylation products of the oxoalcohols and secondary alcohols of the corresponding chain lengths. Other suitable nonionic surface-active compounds or tensides are the water-soluble adducts of ethylene oxide adducted onto polypropylene glycol or alkylenediaminepolypropylene glycol or with alkylpolypropylene glycols with 1 to 10 carbon atoms in the alkyl, said adducts containing 20 to 250 ethylene glycol ether groups and 10 to 100 propylene glycol ether groups, in which the polypropylene glycol chain acts as hydrophobic group. All of these compounds, used in amounts of from 5% to 60% by weight of the coating, cause a uniform distribution of the active substances and fragrances during the preparation and application of the products according to the invention.

Antimicrobial active substances, either bactericidal or bacteriostatic, or fungicidal or fungistatic, compounds also are quaternary ammonium compounds, particularly those that contain, in addition to a long-chain aliphatic and two short-chain, aliphatic hydrocarbon radicals in the molecule, one aromatic radical connected to the nitrogen atom via an aliphatic hydrocarbon atom, or an aliphatic organic radical with double bonds. Typical representatives of such antimicrobial active substances are the compounds dimethylbenzylhexyl-allyl-dodecylammonium chloride. Suitable antimicrobial active substances are also the bromonitro alcohols such as the compounds 2-bromo-2-nitropropane-1,3-diol, 1-bromo-1-nitro-3,3-trichloro-2-propanol, 2-bromo-2-nitrobutanol, etc.

Also suitable as antimicrobial active substances are halogenated and/or trifluoromethylsubstituted phenolic compounds, especially the halogenated salicylanilides, for example, the compounds dibromosalicylanilide and tribromosalicylanilide as well as derivatives of phenoxyphenol as, for example, the compound 2-hydroxy-2',4,4'-trichlorodiphenyl ether.

Compounds suitable for the soil-release treatment for textiles are active substances that improve the soil-lifting capacity during washing. To these belong compounds of the type of the polyacrylpolyvinyl alcohols, the modified fluorohydrocarbons and hydrophilic polymers. Polyvinylacetates, paraffins, but also borax, are suitable as additives that make the ironing of the wash easier.

The products according to the invention are prepared by impregnating a piece of the substrate with the textile softener to which the hydroxylcarboxylic acids or phosphonic acids, as well as, optionally, additives and fragrances were added, in such an amount that the substrate has the impregnation with the active substance which is adequate for the treatment of one load of wash in the automatic clothes drier. This is from 0.5 to around 10 gm for a household clothes drier with a 4 to 5 kg (dry weight) capacity. An amount of 1 to 5 gm, which is present on the substrate when such a product is used for the first time, is generally adequate. Such an amount of active substance is adsorbed by the substrate suitable for the agents according to the invention that is about 0.01 to 0.2 $m^2$ in size. A size which is advantageous for practical use is between 0.02 and 0.07 $m^2$. Larger pieces are used for application in commercial laundries, corresponding to the greater capacity of the equipment in use there. The user can place one, two or more pieces with the wash into the clothes drier, if a stronger effect is needed. Instead of one piece of the substrate of this size, a large piece or continuous roll of the substrate is impregnated advantageously for the preparation of the products according to the invention, and this is subsequently divided into pieces of the desired size. The impregnation of the substrate can be performed in various ways. Suitable methods are, for example, printing on both sides, application by rolling on, doctor, spraying, or preferably dipping the substrate into a solution, dispersion or preferably into a melt of the active substance, the fragrance and optional additives, and subsequent drying and/or cooling, for example, by air or indirectly by contact systems. To prevent losses of volatile substances, for example fragrances, the unnecessarily long heating of a melt to an unnecessarily high temperature must be avoided. A temperature of at most 90° C. generally is adequate, and a temperature of not more than approximately 60° C. is generally considered advantageous for the melting of commercial quaternary nitrogen compounds. The regulation of the amount to be applied is possible with metered coating, or saturating the substrate and subsequent squeezing out of the excess through a slit in the roller.

Suitable solvents for solutions and dispersions of the conventional active substances are, for example, the lower alkanols, such as methyl alcohol, ethyl alcohol or isopropyl alcohol, which may be mixed with water, if desired. The solutions as well as the dispersions and melts may contain additives, especially the dispersing agents.

The pieces may have any shape; circular, oval, cornered, geometric or nongeometric forms may be used. In general, four-cornered forms and a roll that is, for example, perforated between the pieces needed for one clothes drier load are preferred.

When moist wash is treated in the clothes drier with the product according to the invention by allowing the agent to act on the wash during the drying process, the dried wash will be pleasant and soft to the touch and have the desired smell after the treatment. In addition, the wash will not have any spots caused by the uneven transfer of the active substance.

EXAMPLES

The examples describe the preparation and mechanism of action of some products according to the invention intended for a household clothes drier. The invention is not to be limited thereto.

EXAMPLE 1

A polyester fiber fleece with a mass per unit of about 40 gm per $m^2$ and an adsorption capacity of 2.8 was dipped in a homogeneous mixture of paste-like di-tallow alkyl-di-methylammonium chloride (75% active substance), to which 1% by weight of citric acid and 3% by weight of a 10% solution of 4,4'-bis-(2-sulfostyrene)-biphenyl (optical brightener for cotton) and 5% by weight of a fragrance, note "flowery/woody" had been added. After cooling and drying, the fleece had absorbed approximately 90 gm per $m^2$ of coating material. After storing for about two to three weeks at 40° C., it was observed that the products prepared in this manner had a markedly reduced tendency to turn yellow in comparison with products that had been prepared without citric acid and optical brightener in the coating material. Test people experienced in the evaluation of fragrances judged to be "more well rounded" and "cleaner" than the fragrance of comparison products, before and after storage. Similarly, the fragrance of the washed treated with the products according to the invention was judged more advantageous.

Determination of the Adsorption Capacity

The adsorption capacity of the substrate of this example, as well as of the other examples, was determined according to the following method. A square piece of the substrate with sides measuring 10 cm in length was placed on a flat glass dish and weighed together with this glass dish. The weight of the substrate determined in this way is the dry weight. This substrate piece was dipped in water of 25° C. for 30 seconds, then removed from the water by one corner with tweezers and allowed to drip for 15 seconds. Immediately after the 15 seconds were over, the substrate piece was again placed on the flat glass dish and weighed together with the latter. The weight of the substrate moistened with water is the wet weight. The adsorption capacity of the substrate was calculated from the wet weight and the dry weight by the following formula:

$$\text{Adsorption capacity} = \frac{\text{wet weight} - \text{dry weight}}{\text{dry weight}}$$

EXAMPLE 2

A similar result was obtained when the softener and antistatic agent of Example 1 was replaced by 1-methyl-1-stearylamidoethyl-2-stearylimidazolinium methosulfate, and 1.5% by weight of glycolic acid was added.

EXAMPLE 3

When 2% by weight of glycolic acid instead of citric acid were added to the coating material of Example 1, the result was comparable.

EXAMPLE 4

A polypropylene fiber fleece, mass per unit area of approximately 42 gm per $m^2$, adsorption capacity 2.6, was coated with a 1:1 mixture of distearyl-dimethylammonium methosulfate and 1-methyl-1-stearylamidoethyl-2-stearylimidazolinium methosulfate, to which 1.5% by weight each of lactic acid and citric acid, as well as 0.5% by weight of a stilbene triazine derivative (Blankophor BBH/S, Bayer) and 7% by weight of fragrance of the note "flowery/fresh" had been added. Again, a result comparable to Example 1 was obtained.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. An odor-stable composition for coating a flexible textile sheet for the treatment of moist wash in a mechanical clothes drier consisting essentially of an active softening composition selected from the group consisting of:

(1) mixtures of cationic quaternary nitrogen compounds having at least one alkyl group having 8 to 26 carbon atoms with small amounts of scenting agents, (2) mixtures of said quaternary nitrogen compounds with small amounts of scenting agents, with up to an equal part by weight of nonionic surface-active compounds, and (3) mixtures of either of components (1) and (2) above wherein part of said quaternary nitrogen compound has been replaced by the condensation products of the condensation of 1 mol of a higher fatty acid triglyceride with a mol of a hydroxy-lower alkyl-loweralkylenediamine or a hydroxy-lower alkylpolyloweralkylene polyamine, in a ratio by weight of from 4:1 to 1:4 of quaternary nitrogen compounds to condensation products, wherein said composition contains from 0.2% to 3% by weight of at least one acid selected from the group consisting of hydroxy-lower alkane-carboxylic acid having from 1 to 2 hydroxyls and from 1 to 3 carboxyls, as well as none or from 0.05% to 1% by weight of at least one optical brightener, both based on the total weight of said active softening composition.

2. The composition of claim 1 wherein said hydroxy-lower alkane-carboxylic acid is a member selected from the group consisting of malic acid, tartaric acid, tartronic acid, lactic acid, glycolic acid, citric acid and mixtures thereof.

3. The composition of claim 2 wherein said hydroxy-lower alkane-carboxylic acid is a member selected from the group consisting of lactic acid, glycolic acid, citric acid and mixtures thereof.

4. The composition of claim 3 wherein said hydroxy-lower alkane-carboxylic acid is citric acid.

5. The composition of claim 1 wherein said quaternary nitrogen compounds are ditallow alkyldimethylammonium salts.

6. The composition of claim 5 wherein said salts are selected from the group consisting of the chloride and the methosulfate.

7. The composition of claim 1 wherein said active textile softening and antistatic substances are said mixtures of said quaternary nitrogen compounds with said condensation product in a weight ratio of 4:1 to 1:4.

8. The composition of claim 7 wherein said higher fatty acid ester is a triglyceride.

9. The composition of claim 7 wherein said hydroxy-lower alkylpolyamine is hydroxyethylethylenediamine.

10. The composition of claim 7 wherein said condensation product is a condensate of 1 mol of a hardened tallow fatty acid triglyceride and 1 mol of hydroxyethylethylenediamine.

11. The composition of claim 1 wherein said quaternary nitrogen compounds are in admixture with said nonionic surface-active compounds.

12. The composition of claim 11 wherein said nonionic surface-active compounds are present in an amount of from 5% to 60% by weight and are ethoxylated alcohols selected from the group consisting of higher alkanols and alkylphenols having from 8 to 18 carbons in the alkyl.

13. The composition of claim 1 wherein said at least one optical brightener is present and is an optical brightener for cotton.

14. An odor-stable composition for coating a flexible textile sheet for the treatment of moist wash in a mechanical clothes drier consisting essentially of an active softening composition selected from the group consisting of:

(1) mixtures of cationic quaternary nitrogen compounds having at least one alkyl group having 8 to 26 carbon atoms with small amounts of scenting agents, (2) mixtures of said quaternary nitrogen compounds with small amounts of scenting agents, with up to an equal part by weight of nonionic surface-active compounds, and (3) mixtures of either of components (1) and (2) above wherein part of said quaternary nitrogen compound has been replaced by the condensation products of the condensation of 1 mol of a higher fatty acid triglyceride with a mol of a hydroxy-lower alkyl-loweralkylenediamine or a hydroxy-lower alkylpolyloweralkylene polyamine, in a ratio by weight of from 4:1 to 1:4 of quaternary nitrogen compounds to condensation products, wherein said composition contains from 1% to 3% by weight of at least one acid selected from the group consisting of hydroxy-lower alkane-carboxylic acid having from 1 to 2 hydroxyls and from 1 to 3 carboxyls, as well as none or from 0.05% to 1% by weight of at least one optical brightener, both based on the total weight of said active softening composition.

* * * * *